United States Patent [19]

Bichsel

[11] 4,030,337

[45] June 21, 1977

[54] PICKUP FOR MEASURING THE RATE OF AN ELECTRONIC TIMEPIECE

[75] Inventor: Daniel Bichsel, La Neuveville, Switzerland

[73] Assignee: Societe Suisse pour l'Industrie Horlogere Management Services S.A., Bienne, Switzerland

[22] Filed: Oct. 21, 1975

[21] Appl. No.: 624,418

[30] Foreign Application Priority Data

Oct. 30, 1974 Switzerland ..... 14510/74

[52] U.S. Cl. ..... 73/6

[51] Int. Cl.[2] ..... G04D 7/12

[58] Field of Search ..... 73/6; 324/80, 56

[56] References Cited

UNITED STATES PATENTS

| | | | |
|---|---|---|---|
| 3,395,566 | 8/1968 | Jucker | 73/6 |
| 3,777,547 | 12/1973 | Izumi et al. | 73/6 |
| 3,857,274 | 12/1974 | Desarzens et al. | 73/6 |
| 3,892,124 | 7/1975 | Reese | 73/6 |
| 3,946,591 | 3/1976 | Yanagawa et al. | 73/6 |

*Primary Examiner*—Charles A. Ruehl

*Attorney, Agent, or Firm*—Griffin, Branigan and Butler

[57] ABSTRACT

Pickups for the measurement of the accuracy of electronic timepieces are disclosed. The pickups each include an induction-winding detector and an integrated-circuit frequency divider which is the same as the integrated-circuit frequency divider of timepieces to be measured therewith. The pickups are useful as accessories for chrono-comparators which are normally used to measure the accuracy of mechanical, or sonic, frequency timepieces. Individual ones of these pickups are used to test timepieces of different frequencies by a simple substitution of pickups.

6 Claims, 3 Drawing Figures

FIG.1.
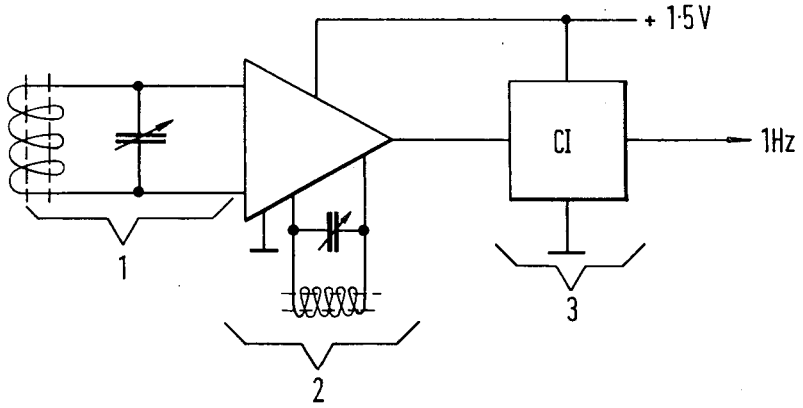
FIG.2.
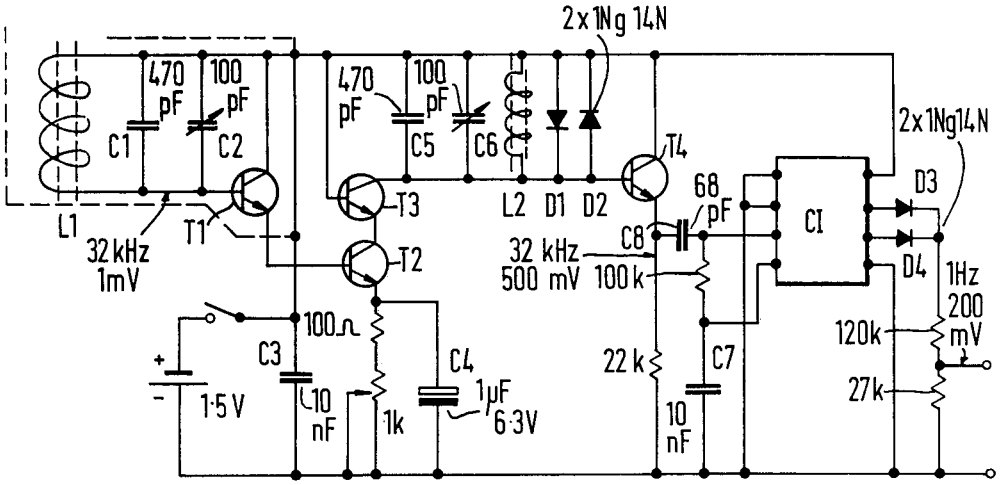
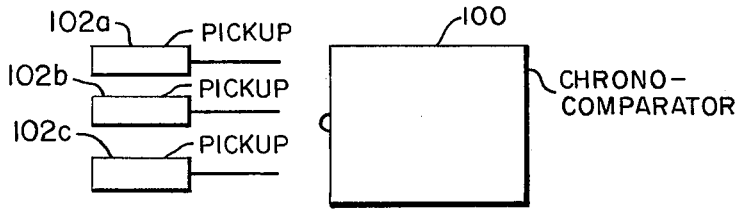
FIG. 3

PICKUP FOR MEASURING THE RATE OF AN ELECTRONIC TIMEPIECE

The invention concerns a pickup for measuring the instantaneous rate of an electronic timepiece for which the time-keeping standard or resonator generates a train a high frequency electric pulses and in particular for which the time-keeping standard is of the piezoelectric type as for example quartz.

In timepieces of this type, in general the high frequency of the resonator is brought down by a dividing circuit to a frequency of 1 Hz, at which frequency the winding of a drive motor is energized in order to bring about movement of an indicating means for displaying time, or in certain cases there is energized a display of the digital type without moving parts.

Electronic apparatus for measuring the instantaneous rate of mechanical timepieces or electronic timepieces of the sonic frequency type are known in which as shown for instance in U.S. Pat. No. 3,857,274 a first unit length of time is determined by counting a number of periods of oscillation(s) of the timekeeper, a second unit length of time is determined by counting a corresponding number of periods of a standard oscillator and periods of the standard oscillator are counted during an interval equal to the difference between the first and second unit times. The result is easily converted into seconds per day.

It has been found practical to choose as units the second of the timepiece and the second of the standard frequency. One thus brings down to a measured second the period of the oscillator undergoing test and to an ideal second that of the standard, by utilizing appropriate frequency dividers. The entire apparatus may be utilized, with the exception of the portion which furnishes the actual second from the timepiece, for measuring the instantaneous rate of timepieces of different nominal frequencies. Only the rate of division of the actual frequency is adjusted in accordance with the timepiece, by a selecting device effective over the usual range of nominal input frequencies. This divider may be cut out of the circuit in such a fashion that a measured nominal frequency of 1 Hz applied from the exterior may be injected at the divider output point into the circuit.

Equally known are arrangements for measuring the instantaneous rate of timepieces having quartz resonators. In the latter a reference time base utilizing a quartz resonator controls the frequency of a secondary oscillator. The oscillations of the quartz of the timepiece under test are detected, the signals obtained therefrom are amplified and their frequency is compared to that of the secondary oscillator. The result of this comparison is then transformed in such a manner that it may be displayed in a digital form or if so desired analogue form. In addition to a high level of consumption due to the type of circuits utilized these arrangements have as a major draw-back the fact that they are adapted only for measuring the instantaneous rate of timepieces all of which have the same nominal frequency, as for example 32,768 Hz. It is thus necessary to use a second apparatus having a different characteristic for testing timepieces of a different frequency from whence there arises a necessity for a number of different instruments to be available at the watch repairers shop in order to accommodate various types of timepieces.

This invention has as its purpose to escape the abovementioned difficulties and others as well arising therefrom as for instance the space occupied, cost, types of different manipulations necessary etc. The invention offers the possibility of measuring the instantaneous rate of high frequency timepieces, while using basic existing equipment hitherto used for measuring mechanical or sonic frequency timepieces. To this effect the invention provides a pickup having a detector and being adapted to capture oscillations from a high frequency timepiece resonator such as a piezoelectric resonator and to provide an output signal derived from the actual frequency of the oscillations at a nominal frequency of 1 Hz, such output signal being matched to a chronocomparator designed for the determination of the instantaneous rate of a mechanical or sonic frequency timepiece. The arrangement is thus limited to a simple accessory of the basic chrono-comparator equipment which requires only the substitution of this accessory in order to proceed from testing a timepiece of one frequency to that of another frequency. The pickup in accordance with the invention is essentially characterized by the fact that it includes a frequency divider in the form of an integrated circuit as used in a timepiece operating at the same frequency as that being tested and which, in fact, may be identical to that used as frequency divider in the timepiece being tested. In a preferred arrangement the pickup comprises a tuned amplifier circuit which operates at low voltage between the detector and the frequency divider circuit.

For a better understanding of the description which follows reference will be had to the attached drawings in which:

FIG. 1 is a schematic drawing of the pickup arrangement in accordance with the invention.

FIG. 2 is a schematic detail drawing, not intended to be limiting of the electronic circuit of a pickup in accordance with the invention intended to operate at a nominal frequency of 32,768 Hz.

FIG. 3 is a block diagram showing a system including a plurality of pickups for this invention, each for a separate frequency timepiece, and a chrono-comparator.

As shown by FIG. 1 a pickup in accordance with the invention comprises a detector 1, an amplifier stage 2 and a divider circuit 3 from which the output signals may be transmitted to the input of a chrono-comparator matched to a frequency of 1 Hz. The detector arrangement 1 is shown in the form of an induction winding coupled to an adjustable condensor to form an antenna circuit tuned to the nominal frequency of the resonator of the timepiece to be measured. The latter may be provided with any oscillator circuit having for example a piezoelectric resonator and which may generate an electro-magnetic output capable of being detected. The signals captured by detector 1 at the level of about one millivolt are amplified and filtered in the tuned amplifier 2 in such a manner as to bring them to a level of the order of several hundreds of millivolts which matches them to the input of divider 3. The divider circuit 3 in conformity with the invention is an integrated circuit identical to that which is used in a timepiece for which the oscillator has the same nominal frequency as that which is undergoing test. This type of circuit of a very small size serves normally in the timepiece to bring down the high frequency of the oscillator by means of a series of divider stages to a frequency of 1 Hz and to deliver signals at this frequency suitable for energizing the winding of a drive motor for the indicating means, or to control the display of time if the indicating means does not consist of moving parts. In the case of the pickup in accordance with the invention the integrated circuit 3 delivers in the same manner signals at a nominal frequency of 1 Hz representative of the actual frequency of the oscillator of the timepiece. Such signals are transmitted to the input of a chrono-comparator 100 which will then compare this nominal frequency of 1 Hz with the ideal frequency of 1 Hz as provided by a time standard normally forming an integral part of the said chrono-comparator.

By way of example FIG. 2 shows a detail schematic drawing of a pickup arrangement for measuring the rate of a timepiece operating at a frequency of 32,768 Hz. The antenna detector circuit is tuned so as to furnish signals of about 1 mV. It comprises a winding $L_1$, a fixed condensor $C_1$ and a variable condensor $C_2$. It is coupled by the impedance matching transistor $T_1$ to a tuned amplifier formed by two transistors $T_2$ and $T_3$ and a circuit comprising a winding $L_2$ and fixed and variable condensors $C_5$ and $C_6$. Two diodes $D_1$ and $D_2$ serve as amplitude limiters in order to protect the integrated divider circuit $C_1$ which is arranged to receive signals of about 500 mV at a measured nominal frequency of 32,768 Hz via impedance matching transistor $T_4$. The output of the divider circuit after conversion to a single polarity output signal by two diodes $D_3$ and $D_4$ comprises signals at a nominal measured 1 Hz brought to a level of about 200 mV in order to be applied to the input of the chrono-comparator.

The pickup arrangement which has just been described is of extreme simplicity by virtue of which a low cost price and small dimensions permits it to be placed into a casing of extremely small size, the greatest dimension being in the order of a dozen centimeters. It is energized by a DC source of 1.5 V which may be a simple dry cell as found in commerce and may, by its construction, be advantageously placed in the same case thereby rendering the entire pickup device completely independent.

This pickup arrangement is thus a true accessory of the chrono-comparator which constitutes the base equipment. The constitution of the integrated divider circuit depends essentially on the frequency which is intended to be divided, and it is thus evident that there will be required one pickup 102*a*, 102*b*, 102*c*, etc. for each separate frequency timepiece type to be measured.

The watchmaker thus will only need to be equipped for the usual frequencies and will be able with this equipment to measure all the usual types of timepieces working at such frequencies whatever might be their origin.

What we claim is:

1. A pickup adapted for detecting signals from the oscillator of a high-frequency electronic timepiece and for providing an output signal at a nominal frequency of 1Hz, said pickup being usable by a chrono-comparator designed for the determination of the instantaneous rates of mechanical or sonic frequency timepieces by comparing the timepieces' actual frequencies with an ideal frequency of 1 Hz obtained from a reference standard, said pickup comprising:

a detection means for detecting said signals of said high-frequency timepiece and providing an actual signal corresponding to the frequency of the timepiece oscillator signals, and an integrated frequency divider circuit connected to said detection means for dividing the frequency of said actual signal and for providing said output signal at said nominal frequency of 1 Hz, said integrated frequency-divider circuit being the same as an integrated frequency-divider circuit in a timepiece operating at the same oscillator frequency as timepieces tested with said pickup means.

2. A pickup as set forth in claim 1 wherein the integrated, frequency-divider circuit is identical to that used as a frequency divider in a timepiece to be tested therewith.

3. A pickup as set forth in claim 2 wherein there is included a tuned amplifier circuit operating at low voltage between the detection means and the integrated frequency-divider circuit.

4. A pickup as set forth in claim 1 wherein there is included a tuned amplifier circuit operating at low voltage between the detection means and the integrated frequency-divider circuit.

5. A system for determining the accuracies of high-frequency watches having oscillators oscillating at different frequencies, said system including:

a chrono-comparator designed for determination of the instantaneous rate of a mechanical or sonic frequency timepiece by comparing the timepiece's nominal frequency with an ideal frequency of 1 Hz obtained from a reference standard to measure the accuracy of said timepiece;

a plurality of separate pickups each adapted for detecting an oscillating timepiece signal of a frequency different from the other pickups and for providing an output signal at a nominal frequency near 1 Hz usable by the chrono-comparator, each of said pickups including:

a detection means for detecting said oscillating timepiece signal and providing an output signal at said nominal frequency corresponding to the frequency of said timepiece signal, and an integrated frequency-divider circuit connected to said detection means for dividing the frequency of said timepiece signal and for providing said output signal, said integrated frequency divider circuit being the same as an integrated frequency-divider circuit in a timepiece operating at the same frequency as the timepieces to be tested with the respective pickup;

the integrated frequency-divider circuit in each of these pickups being different from the integrated frequency divider circuits in the other pickups.

6. A system as in claim 5 wherein the integrated frequency-divider circuits of the various pickups are identical to the integrated frequency-divider circuits of the respective timepieces to be tested therewith.

* * * * *